US005195886A

United States Patent [19]

Ida

[11] Patent Number: 5,195,886

[45] Date of Patent: Mar. 23, 1993

[54] COMBUSTION HEATER

[75] Inventor: Hiroyuki Ida, Konan, Japan

[73] Assignee: Zexel Corporation, Tokyo, Japan

[21] Appl. No.: 586,501

[22] Filed: Sep. 21, 1990

[30] Foreign Application Priority Data

Sep. 29, 1989 [JP] Japan ..... 1-114678[U]
Oct. 31, 1989 [JP] Japan ..... 1-128313[U]

[51] Int. Cl.[5] ..... F23N 5/00

[52] U.S. Cl. ..... 431/30; 237/2 A; 126/110 C; 126/110 D

[58] Field of Search ..... 431/45, 46, 25, 24, 431/71, 72, 73, 258, 259, 66, 67, 6, 30, 31, 33; 237/2 A, 12.3 C; 126/110 C, 110 D, 110 B

[56] References Cited

U.S. PATENT DOCUMENTS 4,070,143 1/1978 Dietz ..... 431/45 X
4,230,444 10/1980 Matthews ..... 431/45 X
4,519,772 5/1985 Mittmann ..... 431/45

FOREIGN PATENT DOCUMENTS 58-15861 7/1956 Japan .
58-57065 4/1983 Japan .

*Primary Examiner*—Henry A. Bennet
*Attorney, Agent, or Firm*—Frishauf, Holtz, Goodman & Woodward

[57] ABSTRACT

According to a first aspect of the invention, a combustion heater has an ECU for controlling operations of a glow plug, a battery, a fuel pump, and a blower for supplying air to a combustor. The ECU is responsive to an instruction signal instructing starting ignition of the combustor for starting to cause the battery to apply a first predetermined voltage to the glow plug, and at the same time starting to cause both of the fuel pump and the blower to operate for a predetermined time period, and when ignition of the combustor is detected, the ECU starts to cause both of the fuel pump and the blower to operate, and at the same time starts to cause the battery to apply a second predetermined voltage lower than the first predetermined voltage to the glow plug. According to a second aspect of the invention, the ECU is responsive to an instruction signal instructing stopping combustion of the combustor for causing the blower to supply air at a flow rate at which air has been supplied to the combustor immediately before the signal is supplied to the ECU, for a first predetermined time period, and after the first predetermined time period has elapsed, the ECU causes the flow rate to be progressively decreased to a first predetermined flow rate over a second predetermined time period, and then causes the blower to supply air at a second predetermined flow rate larger than the first predetermined flow rate.

20 Claims, 14 Drawing Sheets

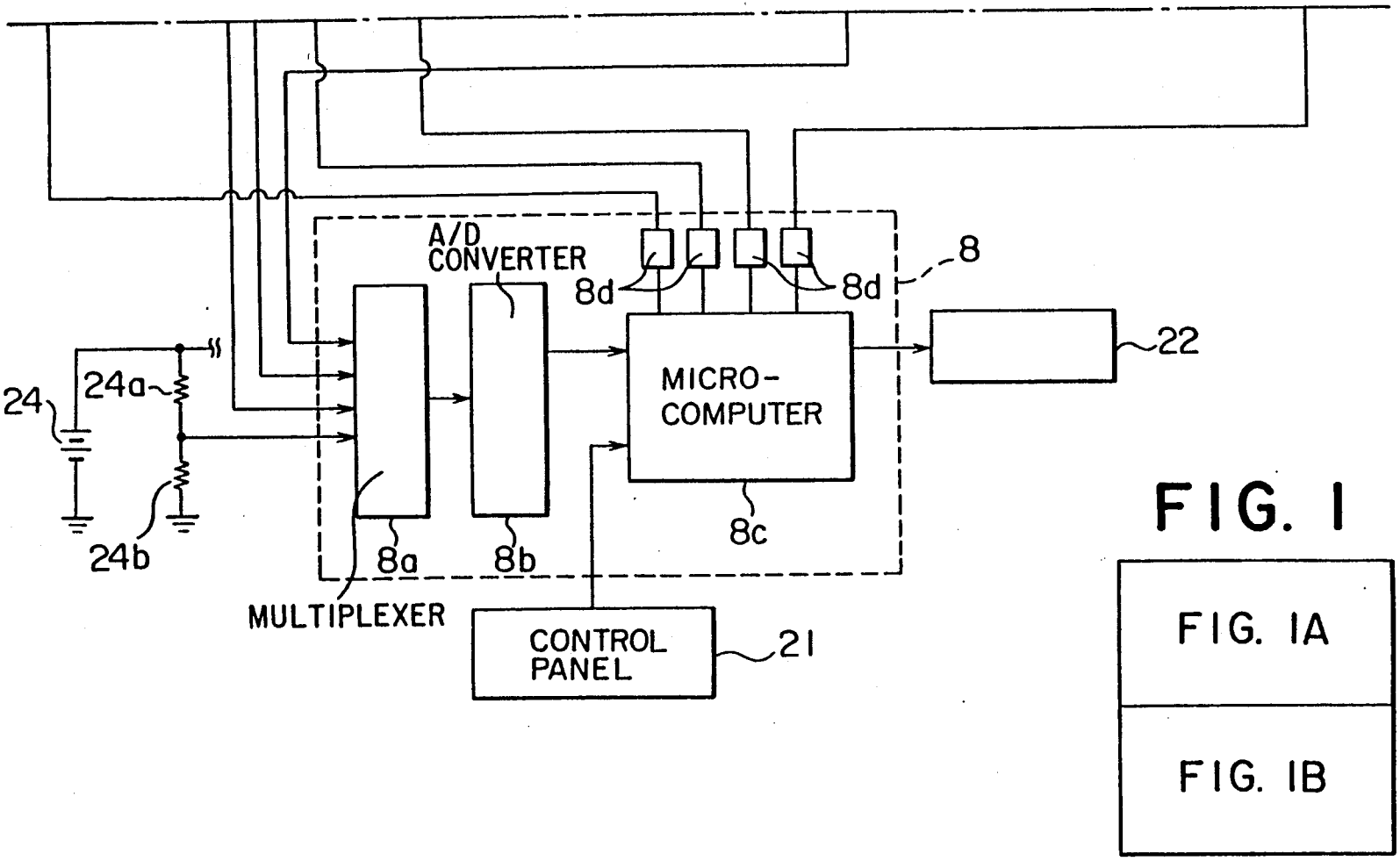
FIG. I
| FIG. IA | FIG. IB |
|---|---|

COMBUSTION HEATER

BACKGROUND OF THE INVENTION

This invention relates to a combustion heater for use in automotive vehicles, and more particularly to a combustion heater of this kind which is excellent in fuel ignitability and durability of a glow plug thereof, and has reduced power consumption, and which can effect positive extinction.

A conventional combustion heater for automotive vehicles, which is used for heating the vehicle compartment or for keeping foods warm, is disclosed in Japanese Provisional Patent Publication (Kokai) No. 58-57065, which comprises a combustor equipped with a glow plug, a voltage-applying device for applying a voltage to the glow plug, a fuel feed pump for supplying fuel to the combustor, a blower for supplying air for combustion to the combustor, a sensor for detecting ignition within the combustor, and a control system for controlling the operations of the glow plug, the fuel feed pump, and the blower.

According to this known combustion heater for automotive vehicles, when a signal for starting ignition is supplied to the control system, a battery as the voltage-applying device applies a predetermined voltage to the glow plug for preheating, and after a predetermined time period for preheating has elapsed after the start of application of the predetermined voltage, the fuel feed pump and the blower start to operate in response to control signals from the control system for supplying fuel and air to the combustor.

However, the predetermined time period for preheating is set to such a long time period as to ensure ignition under any condition, taking into consideration the ambient temperature, the combustion chamber temperature, and variations in component parts of the heater, such as the glow plug and the fuel feed pump. Therefore, even when the inside of the combustion chamber is still hot immediately after extinction, preheating is carried out over the same time period as in the case where the combustion chamber temperature is low, which leads to wasteful consumption of electric power and a shortened life of the glow plug.

In a conventional combustion control system of the combustion heater, in general, upon extinction, i.e. when the heater is caused to cease burning, it is necessary to continue feeding the combustor with air after fuel supply is stopped until the remaining fuel in the wick, which is impregnated with fuel, burns out. Therefore, it has been proposed to feed the combustor with air at a predetermined constant flow rate after stoppage of fuel supply, by Japanese Provisional Utility Model Publication (Kokai) No. 58-15861. However, since the amount of remaining fuel in the wick progressively decreases and hence the amount of vaporized fuel progressively decreases after stoppage of fuel supply until complete extinction, the amount of air supply becomes excessive if the air is supplied at the predetermined constant flow rate, so that the air-fuel ratio in the combustor becomes lean, which leads to occurrence of pale blue smoke and hence emission of noxious gases, or to blowing-out of the fire before the remaining fuel burns out. Particularly when the fire is blown out before the remaining fuel burns out, white smoke of unburnt gases is produced from residual fuel contained in the wick immediately after the blowing-out of the fire, or the residual fuel is carbonized due to heat remaining in the heater and attached to the wick, resulting in a shortened life and degraded ignitability of the wick.

Further, once extinction of the heater is completed, scavenging has to be effected by continuing air supply in order to cool the heater and discharge gases produced by vaporization of fuel from the heater for safety purposes.

SUMMARY OF THE INVENTION

It is an object of the invention to provide a combustion heater for automotive vehicles, which is excellent in fuel ignitability and durability of the glow plug, and has reduced power consumption.

It is another object of the invention to provide a combustion heater which is capable of completely burning fuel remaining in the wick after stoppage of fuel supply, to thereby prevent emission of noxious gases and improve durability and ignitability of the wick, as well as rapidly effecting cooling of the heater and discharge of gases produced by vaporization of fuel for safety purposes, to sufficient degrees.

To attain the first-mentioned object, according to a first aspect of the invention, there is provided a combustion heater including a combustor having a glow plug, voltage-applying means for applying a voltage to the glow plug, fuel supply means for supplying fuel to the combustor, air supply means for supplying air for combustion to the combustor, ignition-detecting means for detecting ignition of the combustor, and control means for controlling operations of the glow plug, the voltage-applying means, the voltage-applying means, the fuel supply means, and the air supply means.

The combustion heater according to the first aspect of the invention is characterized in that the control means is responsive to an instruction signal instructing starting ignition of the combustor supplied thereto for starting to cause the voltage-applying means to apply a first predetermined voltage to the glow plug, and at the same time starting to cause both of the fuel supply means and the air supply means to operate for a first predetermined time period, and when ignition of the combustor is detected by the ignition-detecting means, the control means starts to cause both of the fuel supply means and the air supply means to operate, and at the same time starts to cause the voltage-applying means to apply a second predetermined voltage lower than the first predetermined voltage to the glow plug.

Preferably, the control means causes the voltage-applying means to apply a third predetermined voltage lower than the first predetermined voltage to the glow plug after a second predetermined time period has elapsed after the the first predetermined time period elapsed, until ignition of the combustor is detected by the ignition-detecting means.

More preferably, the third predetermined voltage is higher than the second predetermined voltage.

Preferably, the second predetermined voltage is applied for a predetermined time period after ignition of the combustor has been detected.

Preferably, after the first predetermined time period has elapsed, whenever a third predetermined time period elapses, the control means causes the air supply means to operate for a fourth predetermined time period.

More preferably, the detection of ignition by the ignition-detecting means is carried out by determining whether or not the ignition-detecting means has a resistance value larger than a predetermined value.

To attain the second-mentioned object, according to a second aspect of the invention, there is provided a combustion heater including a combustor, fuel supply means for supplying fuel to the combustor, air supply means for supplying air to the combustor, and extinction control means responsive to an instruction signal instructing stopping combustion of the combustor supplied thereto for stopping fuel supply by the fuel supply means and causing the air supply means to supply air to the combustor.

The combustion heater according to the second aspect of the invention is characterized in that the extinction control means is responsive to the instruction signal supplied thereto for causing the air supply means to supply air to the combustor at a flow rate at which air has been supplied to the combustor immediately before the instruction signal is supplied to the extinction control means, for a first predetermined time period, and after the first predetermined time period has elapsed, the extinction control means causes the flow rate to be progressively decreased to a first predetermined flow rate over a second predetermined time period, and then causes the air supply means to supply air to the combustor at a second predetermined flow rate larger than the first predetermined flow rate.

Preferably, the first predetermined flow rate of air is maintained over a third predetermined time period.

More preferably, the second predetermined flow rate of air is maintained over a fourth predetermined time period.

Alternatively, the combustion heater includes a heat exchanger, and a sensor for detecting the temperature of the heat exchanger, and the second predetermined flow rate of air is maintained until the temperature of the heat exchanger detected by the sensor becomes lower than a predetermined value.

The above and other objects, features, and advantages of the invention will become more apparent from the ensuing detailed description taken in conjunction with the accompanying drawings.

BRIEF DESCRIPTION OF THE DRAWINGS

FIGS. 1A and 1B, taken together as shown in FIG. 1, are a schematic diagram showing the whole arrangement of a combustion heater according to a first embodiment of the invention;

DETAILED DESCRIPTION

The invention will now be described in detail with reference to the drawings showing embodiments thereof.

Figure 1A:
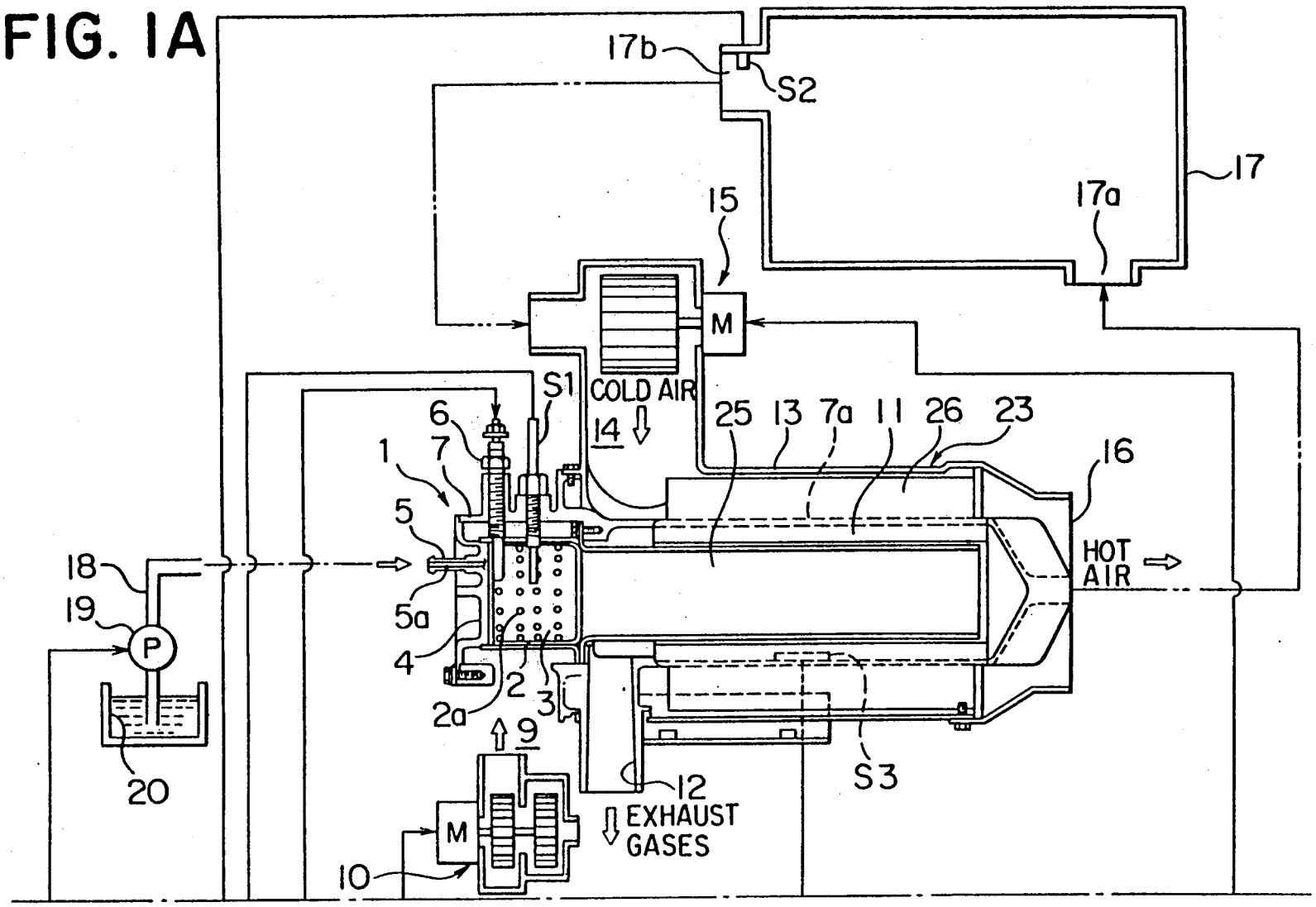

FIGS. 1A and 1B, taken together as shown in FIG. 1, schematically show the whole arrangement of a combustion heater equipped with a combustion control system according to the invention. The heater is installed in an automotive vehicle for transporting warm foods etc. to keep warm an heat-insulating chamber of the vehicle during transportation. In these figures, reference numeral 1 indicates a combustor which produces hot combustion gases by igniting and burning a mixture of vaporized liquid fuel and air in a combustion chamber 3 inside a combustion cylinder 2. The combustor is mainly comprised of the combustion cylinder 2 having the combustion chamber 3 defined therein, a wick 4 to be impregnated with liquid fuel, a passage-forming member 5 having a fuel passage **5*a* formed therethrough for supplying the liquid fuel to the wick 4, and a glow plug 6** for igniting vaporized fuel.

Figure 5:
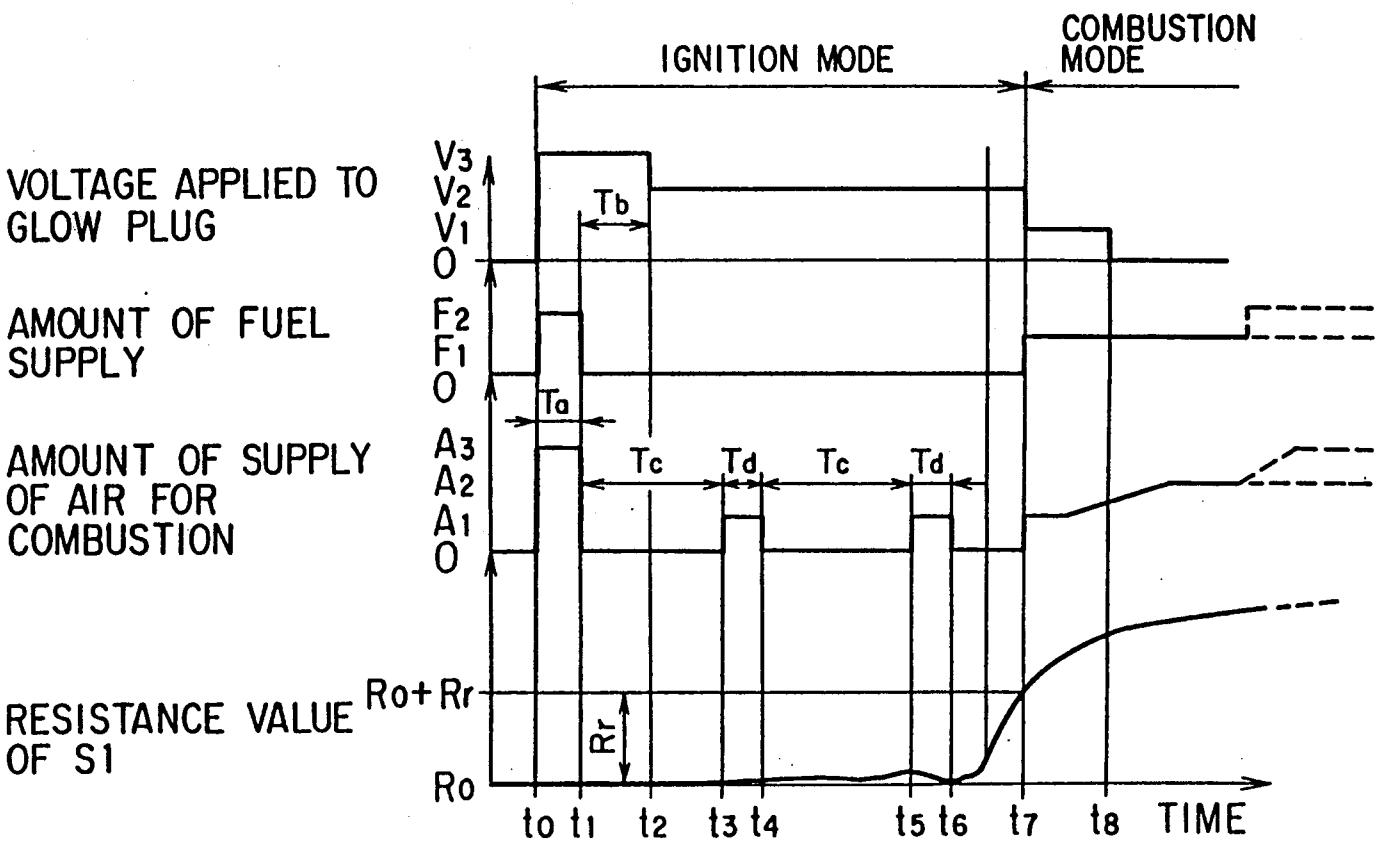
FIG. 5 is a timing chart similar to FIG. 3, according to the embodiment shown in FIGS. 4A and 4B.

A multiplicity of holes **2*a* are formed through the peripheral wall of the combustion cylinder 2 for introducing air into the combustion chamber 3. One end of the combustion cylinder is covered with the disc-shaped wick 4 formed of ceramic fiber. The glow plug 6 is mounted in a casing 7 in which is fitted the combustion cylinder 2, with its tip projected into the combustion chamber 3. The glow plug 6 is electrically connected to an electronic control unit (hereinafter referred to as "the ECU") 8 as control means, referred to hereinafter, such that the voltage applied to the glow plug is controlled to appropriate values ($V_1$ to $V_3$ in FIGS. 3 and 5) by an output signal from the ECU 8**.

An air inlet port 9 of the combustor 1 is provided with a blower 10 for supplying air for combustion. The blower 10 is electrically connected to the ECU 8, such that the flow rate of air for combustion is controlled to appropriate values ($A_1$ to $A_3$ in FIGS. 3 and 5, or $Q_1$ to $Q_4$ in FIG. 7) by an output signal from the ECU 8. Hot combustion gases produced in the combustion chamber 3 flow through a combustion tube 25 within a heat exchanger 23 arranged adjacent the combustor 1. Then, the gases pass through internal fins 11 formed on the inner peripheral wall of a hollow cylindrical part **7*a* of the casing 7, and are discharged from a discharge port 12**.

Further, a cover 13 is arranged radially outwardly of the hollow cylindrical part **7*a* of the casing 7, a portion of which defines an air inlet port 14 provided with a blower 15 for supplying air for heating. The blower 15 is electrically connected to the ECU 8, such that the flow rate of air for heating is controlled to appropriate values (HI, LO in FIG. 7) by an output signal from the ECU 8. The air supplied from the blower 15 passes through external fins 26 formed on the hollow cylindrical part 7*a* of the casing 7 while it is heated by combustion gases passing through the internal fins 11, to effect heat exchange. The air warmed by heat exchange flows via an outlet port 16 into a duct, not shown, and then into a heat-insulating chamber 17 via a warm air inlet port 17***a*.

The fuel passage 5*a* of the passage-forming member 5 communicates with a fuel tank 20 via a conduit 18 and a fuel feed pump 19 as fuel supply means. The fuel feed pump 19 is electrically connected to the ECU 8, such that the amount of fuel supply is controlled to appropriate values ($F_1$, $F_2$ in FIGS. 3, 5, and 7) by an output signal from the ECU 8, which determine the amount of fuel supplied through the fuel passage 5*a* to the wick 4.

An ignition sensor S1 (ignition-detecting means) for detecting whether an air-fuel mixture in the combustion chamber 3 has been ignited is mounted in the casing 7 in the vicinity of the glow plug 6, with its tip projected into the combustion chamber. The sensor S1 comprises a resistance having the characteristic that the internal resistance R thereof increases as the temperature within the combustion chamber increases after ignition of the air-fuel mixture, and a signal indicative of the value of the resistance is supplied to the ECU 8. Further, a temperature sensor S2 for detecting the temperature of the heat-insulating chamber 17 is provided on an inner wall of the heat-insulating chamber 17 in the vicinity of a warm air outlet port 17*b* thereof, and a signal indicative of the temperature of heat-insulating chamber 17 detected by the temperature sensor S2 is supplied to the ECU 8.

A heat exchanger temperature sensor S3 for detecting the temperature of the heat exchanger 23 per se is arranged in the heat exchanger 23, and an output signal from the sensor S3 is supplied to the ECU 8.

Also electrically connected to the ECU 8 are a control panel 21 for outputting signals indicative of instructions by the operator, e.g. for starting the ignition, setting a desired temperature of the heat-insulating chamber 17, stopping the combustion, etc., an abnormality-indicating (warning) device 22 for notifying the operator of an abnormality detected in the combustion heater, and battery voltage-detecting means comprising resistances 24*a* and 24*b* for dividing the output voltage of a battery 24 (voltage-applying means) to detect changes in the output voltage.

The ECU 8 controls the operations of the glow plug 6, the blower 10 for supplying air for combustion, the fuel feed pump 19, and the blower 15 for supplying air for heating, in response to the signals from the sensors S1 to S3 and the control panel 21, in accordance with control programs (FIGS. 2, 4, and 6) referred to hereinafter.

Specifically, the ECU 8 is mainly comprised of a multiplexer 8*a*, and A/D converter 8*b*, a microcomputer (CPU) 8*c*, and a plurality of driving elements 8*d*. The output signals from the sensors S1 to S3 and the voltage signal indicative of changes in the battery voltage inputted to the multiplexer 8*a* are subjected to A/D conversion by the A/D converter 8*b*, and then supplied to the microcomputer 8*c*. The microcomputer 8*c* decides the voltage ($V_1$ to $V_3$) to be applied to the glow plug 6, the amount ($F_1$, $F_2$) of fuel supplied by the fuel feed pump 19, the flow rate ($A_1$ to $A_3$ or $Q_1$ to $Q_4$) of the air for combustion supplied by the blower 10, and the flow rate (HI, LO) of the air for heating supplied by the blower 15, and signals indicative of the decided values are supplied through the respective driving elements 8*d* to the glow plug 6, the fuel feed pump 19, and the blowers 10 and 15, respectively, to control them.

Further, stored in the microcomputer 8*c* beforehand is a duty ratio map of $Q_1$ to $Q_4$ (FIG. 8) for determining duty ratio in response to changes in the power source voltage (the output voltage of the battery 24) for controlling the flow rate of air supplied by the blower 10 after stoppage of fuel supply, referred to hereinafter.

Next, the operation of the combustion heater thus constructed will be described with reference to FIGS. 2 and 3.

Figure 2A:
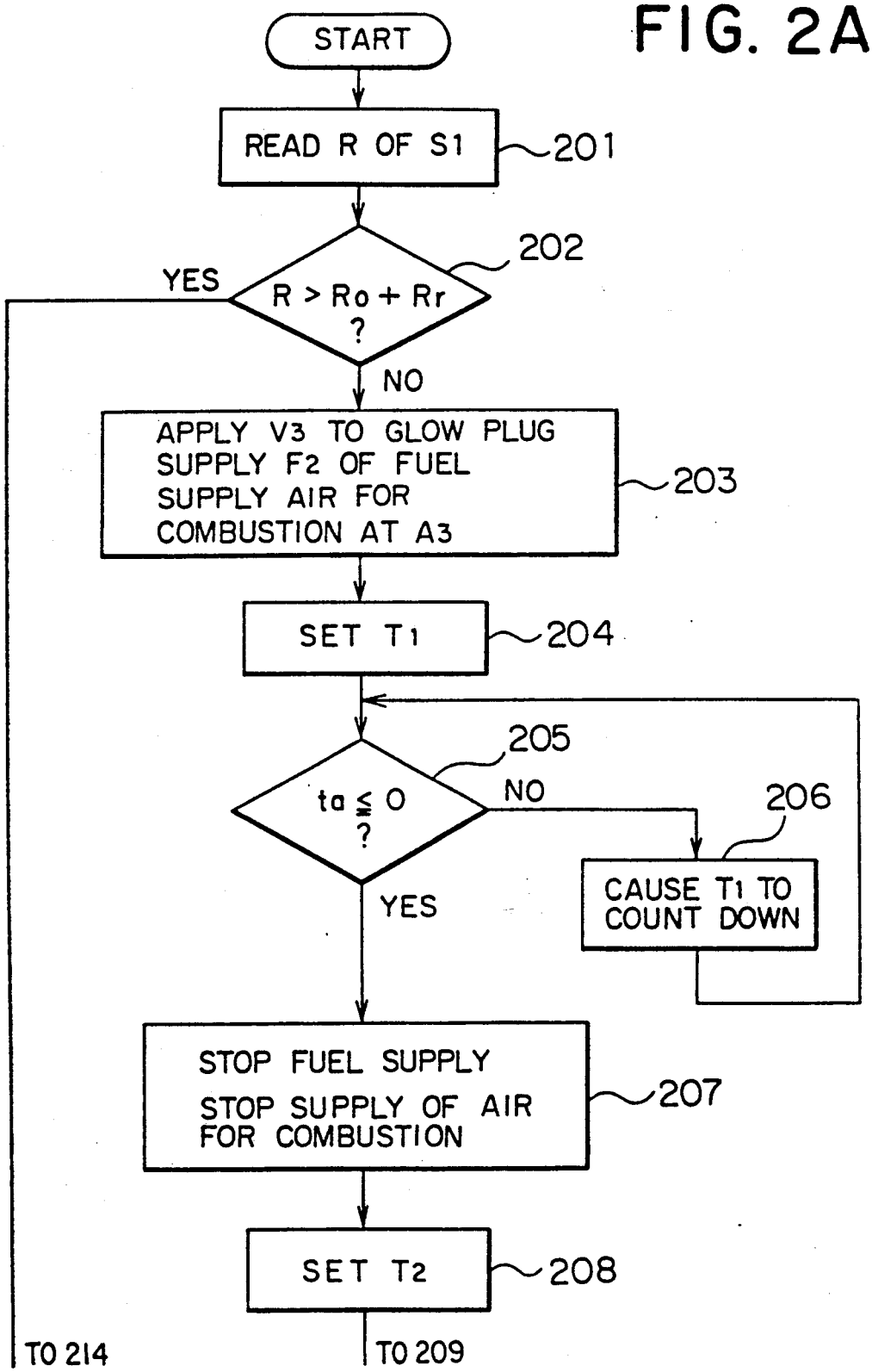
FIGS. 2A and 2B, taken together as shown in FIG. 2, are a flowchart of a program for carrying out ignition and combustion of the combustion heater.
Figure 2B:
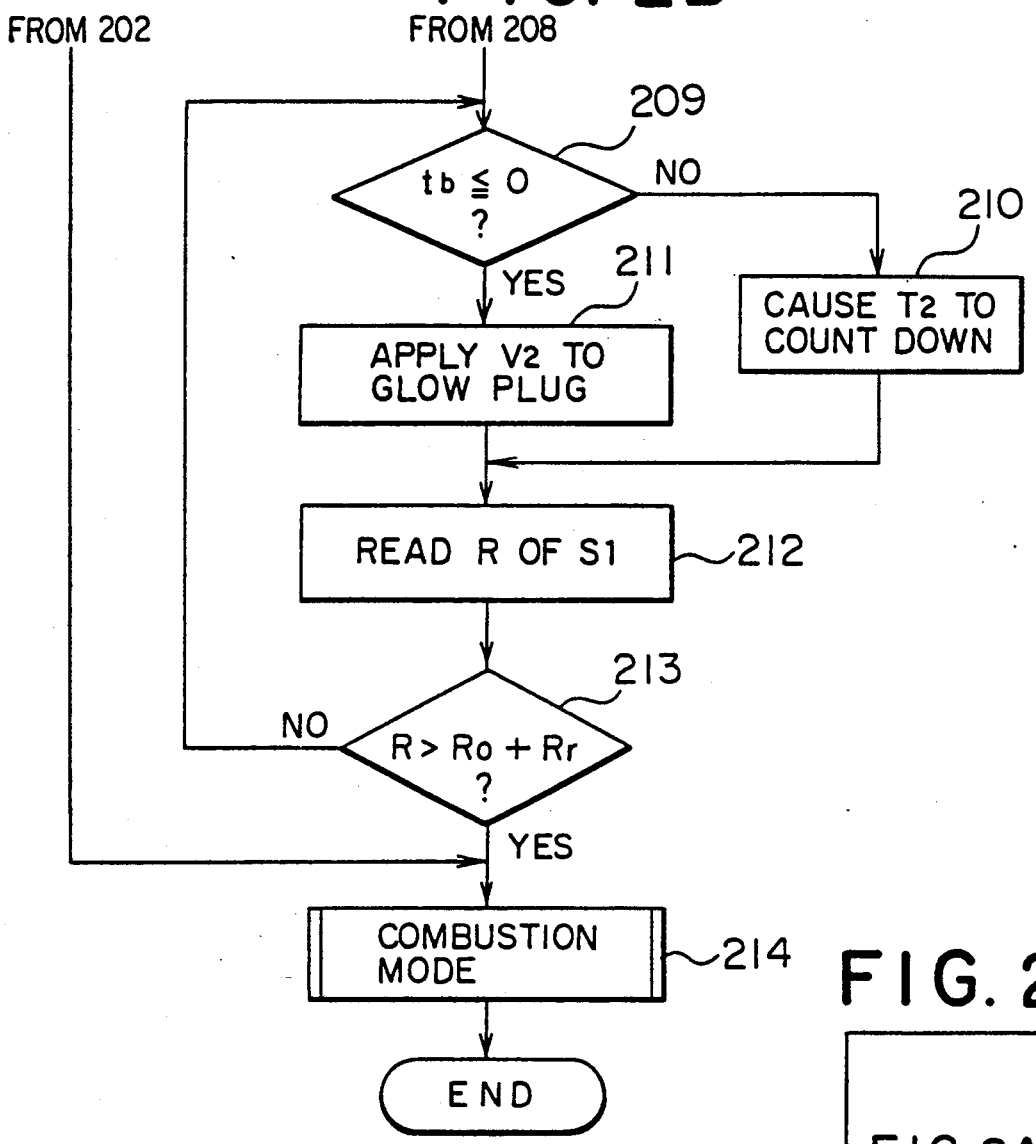
Figure 2:
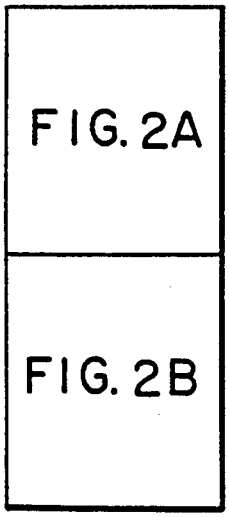

FIGS. 2A and 2B, taken together as shown in FIG. 2, show a program for carrying out the ignition and combustion operations of the combustion heater according to a first embodiment of the invention. This program is started when the instruction signal for starting the ignition is supplied from the control panel 21 to the microcomputer 8*c*.

Figure 3:
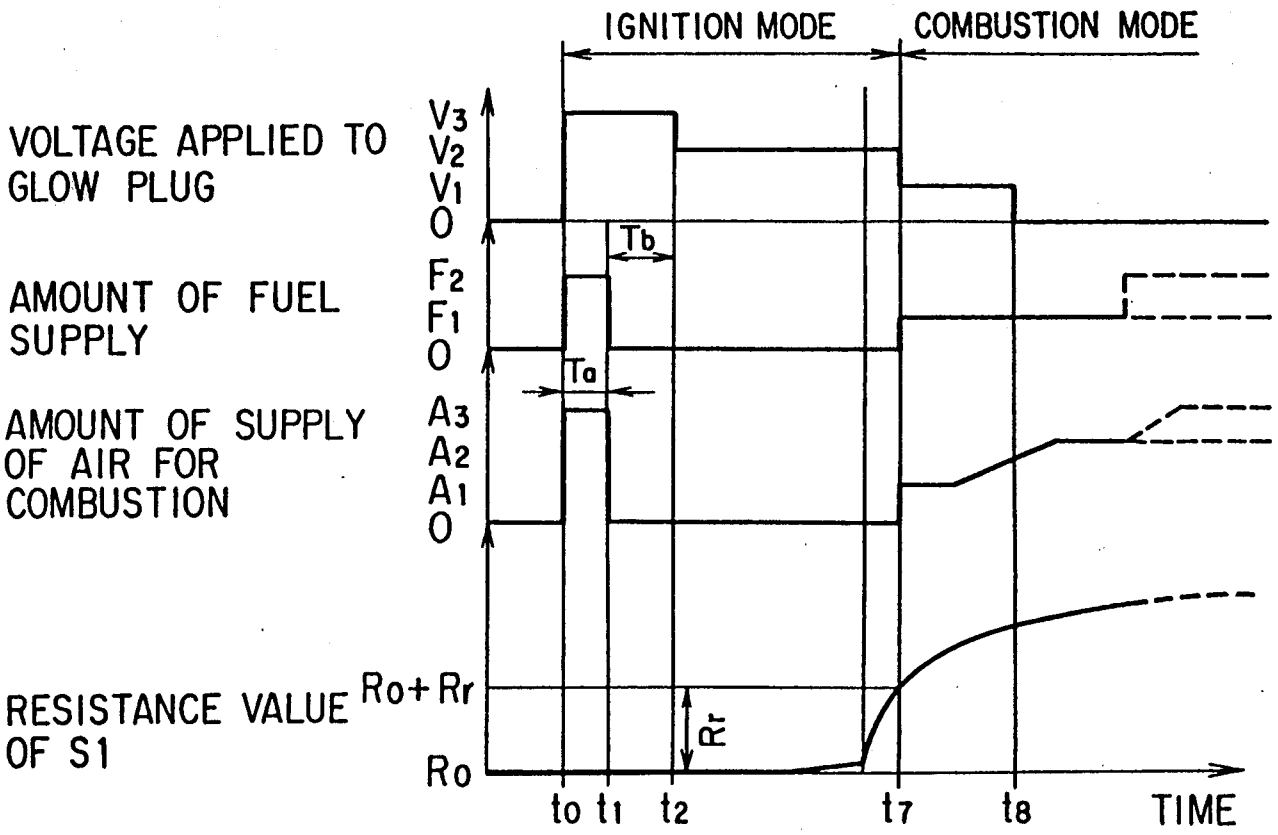
FIG. 3 is a timing chart useful in explaining the operations of component parts of the combustion heater.

The ignition control is started at a time point $t_0$ in FIG. 3, i.e. upon inputting of the instruction signal for starting the ignition.

First, at a step 201, the resistance value R of the ignition sensor S1 is detected. Then, at a step 202, it is determined whether or not the resistance value R is larger than the sum of the basic resitance value $R_0$ and a predetermined value $R_r$. If the answer to this question is affirmative (Yes), i.e. if $R > R_0 + R_r$, which means that ignition has already taken place, the program proceeds to a step 214 where the combustion mode is carried out, followed by terminating the present program. If the answer is negative (No), i.e. if $R \leqq R_0 + R_r$, which means that ignition has not taken place yet, the program proceeds to a step 203. At the step 203, as shown in FIG. 3, a predetermined maximum voltage $V_3$ is applied to the glow plug 6 over a predetermined time period (from $t_0$ to $t_2$). At the same time, the blower 10 is operated to supply air for combustion at a predetermined maximum flow rate $A_3$, and the fuel feed pump 19 is operated to supply a predetermined maximum amount $F_2$ of fuel. By thus applying the maximum voltage at the start of application of the voltage to the glow plug, it is possible to quickly raise the temperature of the glow plug 6. Further, by supplying the air for combustion at the same time of application of the voltage, the combustion chamber 3 is scavenged.

Then, the program proceeds to a step 204, where a timer $T_1$ (down counter) is set to a predetermined time period $T_a$ (i.e. a time period from $t_0$ to $t_1$). Then, at a step 205, it is determined whether or not the count value $t_a$ of the timer $T_1$ is equal to or lower than 0. If the answer to this question is negative (No), i.e. if the predetermined time period $T_a$ has not elapsed, the program proceeds to a step 206, where the timer $T_1$ is counted down, and then the program returns to the step 205.

If the answer to the question of the step 205 is affirmative (Yes), i.e. if the predetermined time period $T_a$ has elapsed (a time point $t_1$ is reached), the fuel feed pump 19 and the blower 10 for supplying air for combustion are caused to stop at a step 207. Then, the program proceeds to a step 208, where a timer $T_2$ is set to a predetermined time period $T_b$ (i.e. a time period from $t_1$ to $t_2$), and the program proceeds to a step 209. At the step 209, it is determined whether or not the predetermined time period $T_b$ has elapsed. If the answer to this question is negative (No), i.e. if the predetermined time period $T_b$ has not elapsed yet, the program proceeds to a step 210, where the timer $T_2$ is counted down, and then the program proceeds to a step 212, where the resistance value R of the ignition sensor S1 is detected, followed by the program proceeding to a step 213.

At the step 213, similarly to the step 202, it is determined whether or not the resistance value R is larger than the sum of the basic resistance value $R_0$ and the predetermined value $R_r$. If the answer to this question is affirmative (Yes), i.e. if $R > R_0 + R_r$ (as at a time point $t_7$), which means that flames have already been produced, the program proceeds to a step 214 where the combustion mode is carried out, followed by terminating the present program.

In the combustion mode, the voltage applied to the glow plug 6 is lowered to a predetermined minimum value $V_1$ at the time point $t_7$ at which occurrence of flames is recognized, and the predetermined minimum voltage is maintained over a predetermined time period (from the time point $t_7$ to $t_8$). After the lapse of this predetermined time period, the application of the voltage to the glow plug 6 is stopped. Further, at the time point $t_7$ at which the voltage applied to the glow plug 6 is lowered to the predetermined minimum value, the fuel feed pump 19 is started to operate to supply a predetermined minimum amount $F_1$ of fuel, and at the same time the blower 10 is started to operate to supply the air for combustion at a predetermined minimum flow rate $A_1$.

If the answer to the question of the step 209 is affirmative (Yes), i.e. if the predetermined time period $T_b$ has elapsed, the voltage applied to the glow plug 6 is lowered to a predetermined medium value V2 at a step 211, and then the program proceeds to the step 212.

If the answer to the question of the step 213 is negative, i.e. if occurrence of flames is not recognized, the program returns to the step 209, and the same procedure is repeated until ignition takes place.

Thus, according to the above described control, the duration of application of the voltage to the glow plug 6 is determined depending on conditions of the heater, such as the ambient temperature, the combustion chamber temperature, and variations in component parts of the heater such as the glow plug 6 and the fuel feed pump 19. For example, when the temperature of the inside of the combustor 2 is higher, the duration of application of the voltage to the glow plug becomes shorter than when the temperature of same is lower.

Figure 4A:
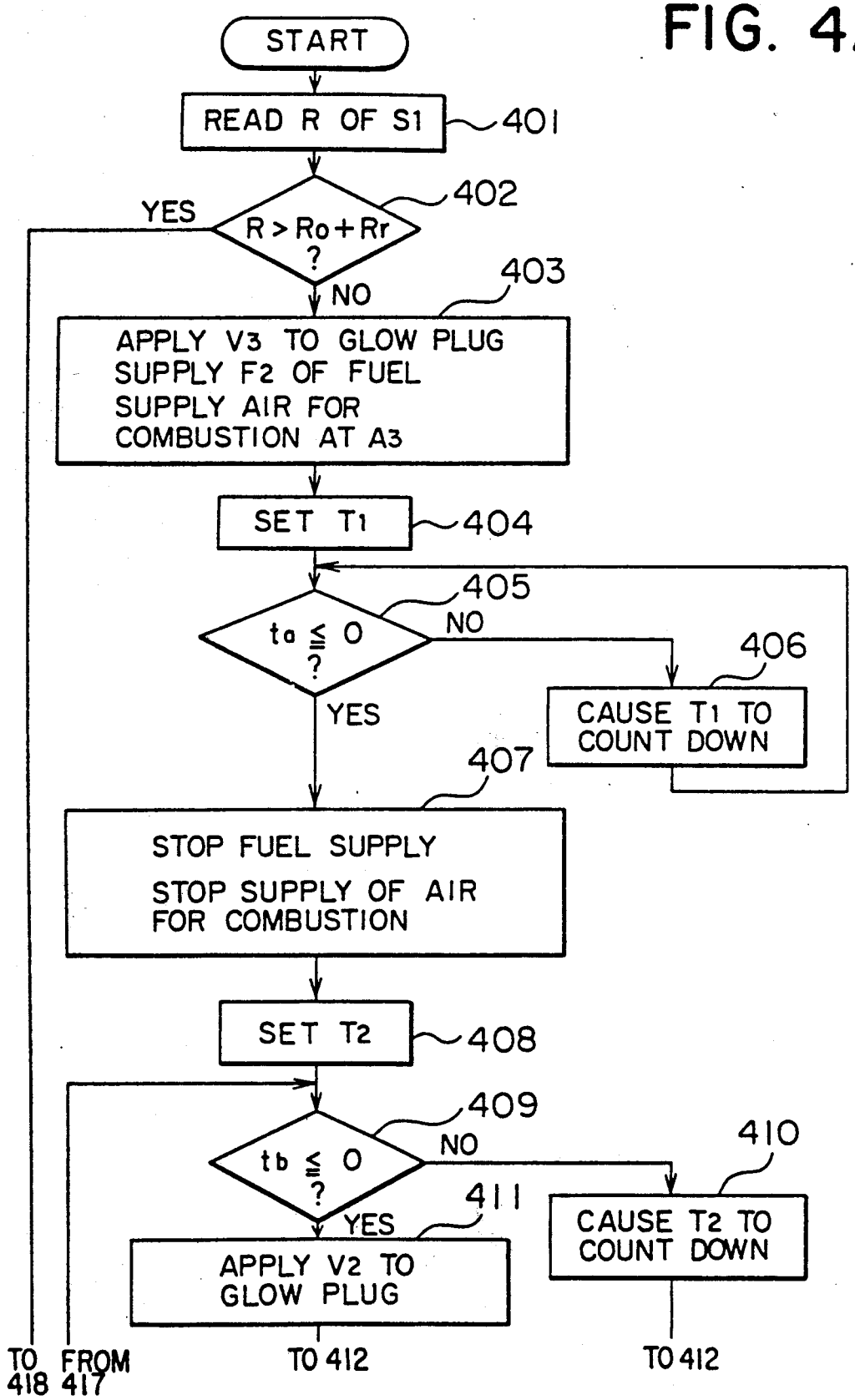
FIGS. 4A and 4B, taken together as shown in FIG. 4, are a flowchart similar to the flow chart of FIGS. 2A and 2B, showing the program according to another embodiment of the invention.
Figures 4, 4A, 4B:
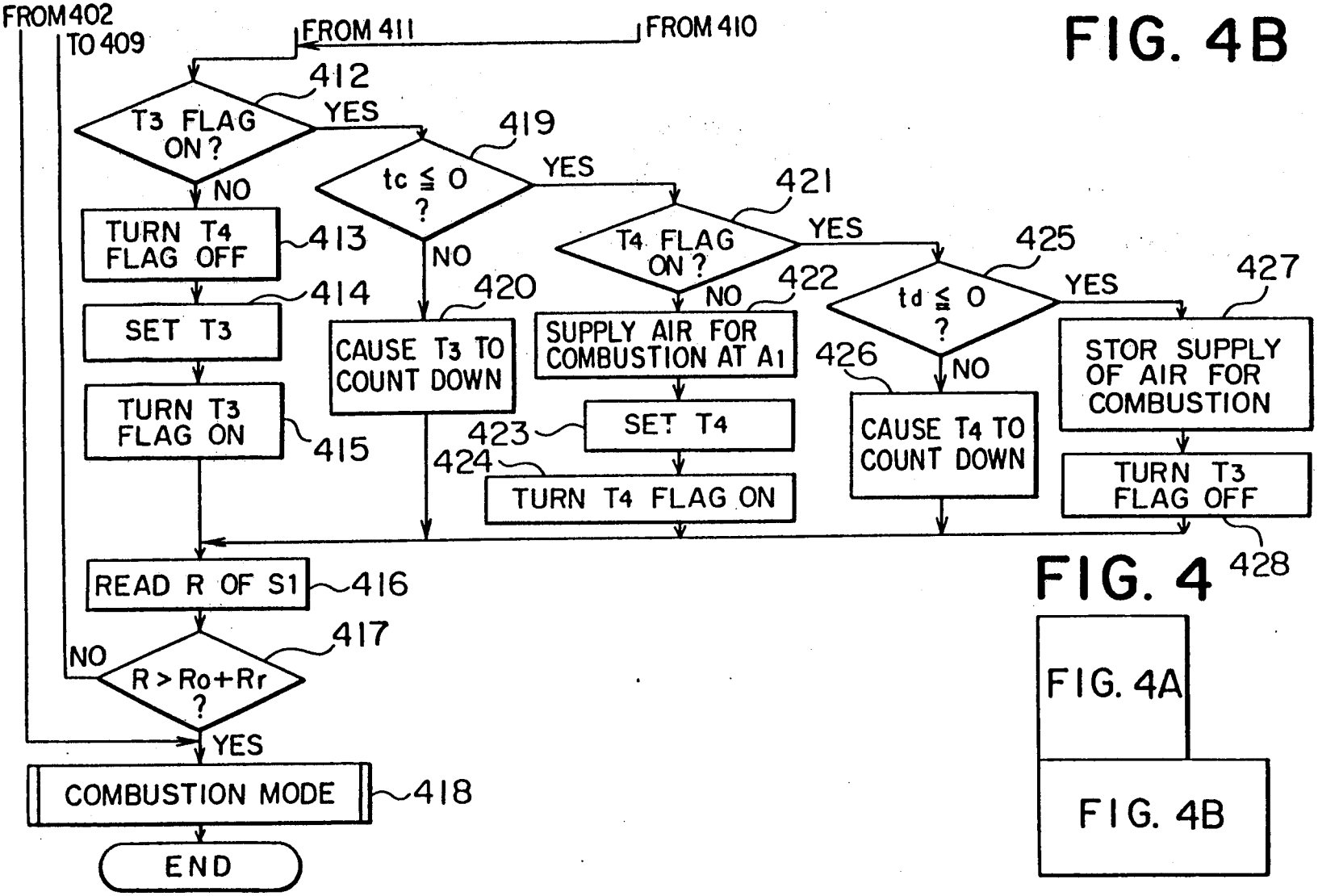

FIGS. 4A and 4B, taken together as shown in FIG. 4, show a program for carrying out the ignition and combustion operations of the combustion heater according to a second embodiment of the invention.

The description of steps 401 to 411, which are identical with the steps 201 to 211 in FIGS. 2A and 2B, is omitted.

At a step 412, it is determined whether or not a flag indicating whether or not a timer $T_3$ is operating is ON. The flag is set to OFF when the timer $T_3$ is not operating. If the answer to this question is negative, i.e. if the flag of the timer $T_3$ is OFF, a flag indicating whether or not a timer $T_4$ is operating is set to OFF to indicate the timer $T_4$ is not operating, at a step 413, and the program proceeds to a step 414, where the timer $T_3$ is set to a predetermined time period $T_c$ (equal to a time period from $t_1$ to $t_3$). Then, the flag of the timer $T_3$ is set to ON at a step 415. The program then proceeds to a step 416, where the resistance value R of the ignition sensor S1 is detected, and then at a step 417, it is determined whether or not the detected value R is larger than the sum of the basic resistance value $R_0$ and the predetermined value $R_r$. If the answer to this question is affirmative (Yes), the occurrence of flames is recognized, and the program proceeds to a step 418, where the combustion mode is carried out, followed by terminating the present program.

If the answer to the question of the step 412 is affirmative (Yes), i.e. if the flag of the timer $T_3$ is ON, the program proceeds to a step 419, where it is determined whether or not the count value $t_c$ of the timer $T_3$ is equal to or smaller than 0, i.e. whether the predetermined time period $T_c$ has elapsed. If the answer to this question is negative (No), i.e. if the predetermined time period $T_c$ has not elapsed yet, the program proceeds to a step 420, where the timer $T_3$ is counted down, followed by the program proceeding to the step 416.

If the answer to the question of the step 419 is affirmative (Yes), i.e. if the predetermined time period $T_c$ has elapsed, it is determined at a step 421 whether or not the flag of the timer $T_4$ is ON. If the answer to this question is negative (No), i.e. if the flag of the timer $T_4$ is OFF, the blower 10 is caused to operate to supply air for combustion at the predetermined minimum flow rate $A_1$ at a step 422, whereby too rich an air-fuel mixture is blown out of the combustion chamber 3. Then, the program proceeds to a step 423, where the timer $T_4$ is set to a predetermined time period $T_d$ (equal to a time period from $t_3$ to $t_4$). At a step 424, the flag of the timer $T_4$ is set to ON, and the program proceeds to the step 416.

If the answer to the question of the step 421 is affirmative (Yes), i.e. if the flag of the timer $T_4$ is ON, it is determined at a step 425 whether or not the count value $t_d$ of the timer $T_4$ is equal to or smaller than 0, i.e. whether or not the predetermined time period $T_d$ has elapsed. If the answer to this question is negative (No), i.e. if the predetermined time period $T_d$ has not elapsed yet, the predetermined time period $T_d$ is counted down at a step 426, followed by the program proceeding to the step 416.

If the answer to the question of the step 425 is affirmative (Yes), i.e. if the predetermined time period $T_d$ has elapsed, the blower 10 is caused to stop at a step 427, and then the flag of the timer $T_4$ is set to OFF at a step 428, followed by the program proceeding to the step 416.

If the answer to the question of the step 417 is negative (No), i.e. if the occurrence of flames is not recognized, the program returns to the step 409. This procedure is repeated until the occurrence of flames is recognized.

The above described control according to the second embodiment of the invention has the following advantageous effect: If ignition does not take place before the predetermined time period equal to the time period from $t_1$ to $t_3$ elapses, fuel supplied to the wick 4 by the ignition control mode continues to be vaporized to form too rich an air-fuel mixture filling the combustion chamber 3, which makes it difficult to effect ignition of the combustor 2. Therefore, the combustion chamber 3 is kept under a condition in which ignition easily occurs, by supplying a small amount of air to scavenge same.

Figure 6:
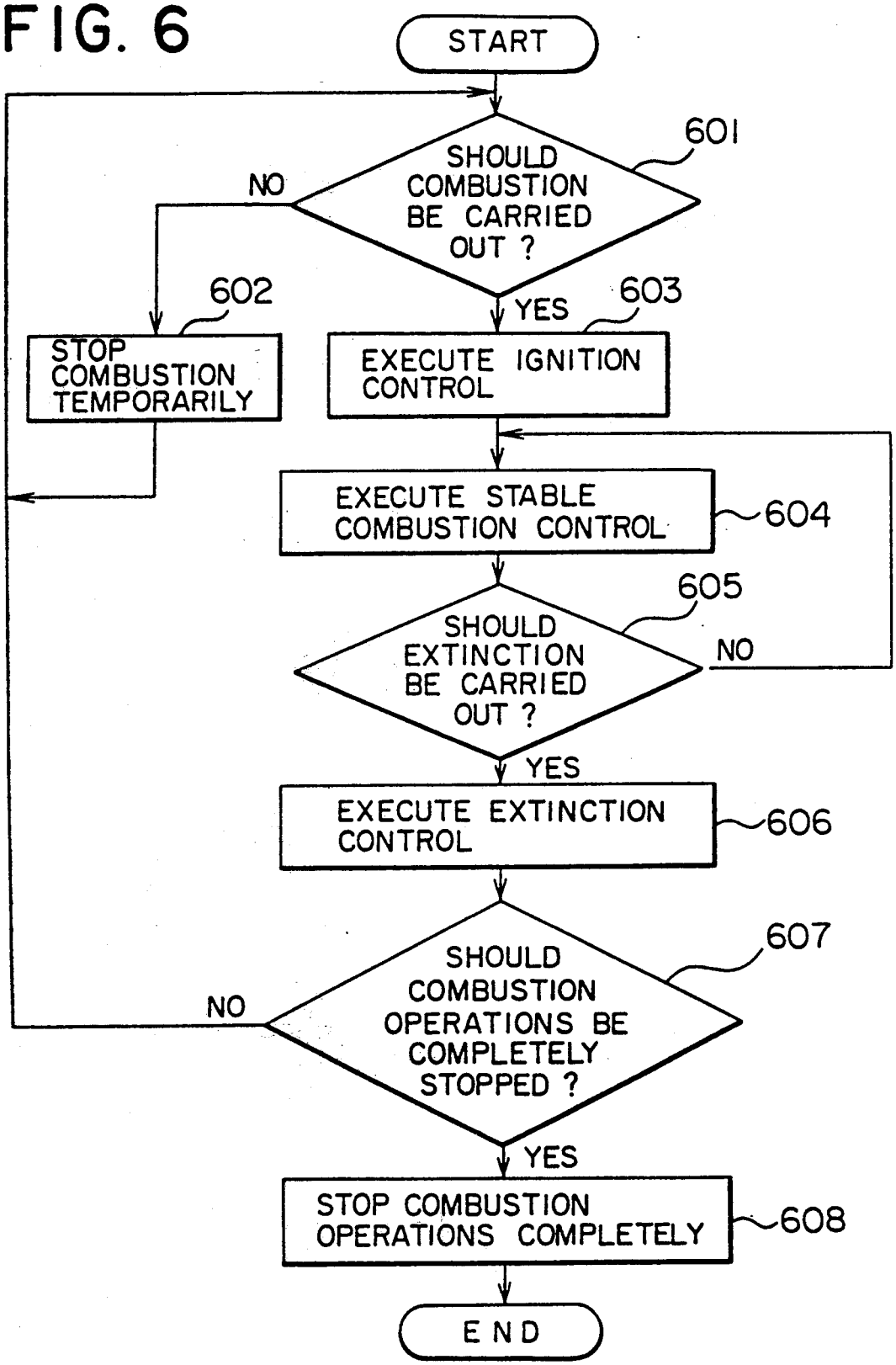
FIG. 6 is a flowchart of a program for controlling the combustion of the combustion heater, to which are applicable third and fourth embodiments of the invention.

FIG. 6 shows a program for carrying out the ignition, combustion, and extinction operations of the combustion heater to which are applicable third and fourth embodiments of the invention.

First, at a step 601, it is determined based on the signals from the sensors S1 to S3 etc. whether or not combustion of the combustion heater should be carried out. If the answer to this question is negative (No), the flow rate of air for combustion to be supplied by the blower 10 is set to a value $Q_3$, and the flow rate of air for heating to be supplied by the blower 15 is set to a value LO, to thereby put the heater under a condition in which combustion is temporarily stopped (step 602), and then the program returns to the step 601.

If the answer to the question of the step 601 is affirmative (Yes), the ignition control for causing the glow plug 6 to effect ignition is carried out at a step 603, and after ignition takes place, stable combustion control is carried out at a step 604 to maintain the temperature of the heat-insulating chamber 17 at a desired value.

Then, at a step 605, it is determined whether or not the combustion heater is in a condition in which the combustion thereof should be immediately stopped, e.g. whether or not the heater switch of the control panel 21 is off, or the engine key is removed, or the temperature indicated by the heat exchanger temperature sensor S3 is abnormally high, or there is failure in a component part of the control system, etc. If the answer to this question is negative (No), the program returns to the step 604 to continue the stable combustion control, whereas if the answer is affirmative (Yes), the program proceeds to a step 606, where there is carried out extinction control by extinction control means, referred to hereinafter, according to the third and fourth embodiments of the invention. The extinction control is for causing fuel remaining in the wick 4 to burn out, and effecting cooling of the heater and blowing-out of gases produced by vaporization of the remaining fuel, after the fuel supply by the fuel feed pump 19 is stopped.

After execution of the extinction control, the program proceeds to a step 607, where it is determined whether or not the operations of the blower 10 for supplying air for combustion and the blower 15 for supplying air for heating should be completely stopped. If the answer to this question is negative (No), the program proceeds to the step 601 to repeat the program, whereas if the answer is affirmative (Yes), the program proceeds to a step 608, where the blowers 10 and 15 are turned off, followed by terminating the present program.

Figure 7:
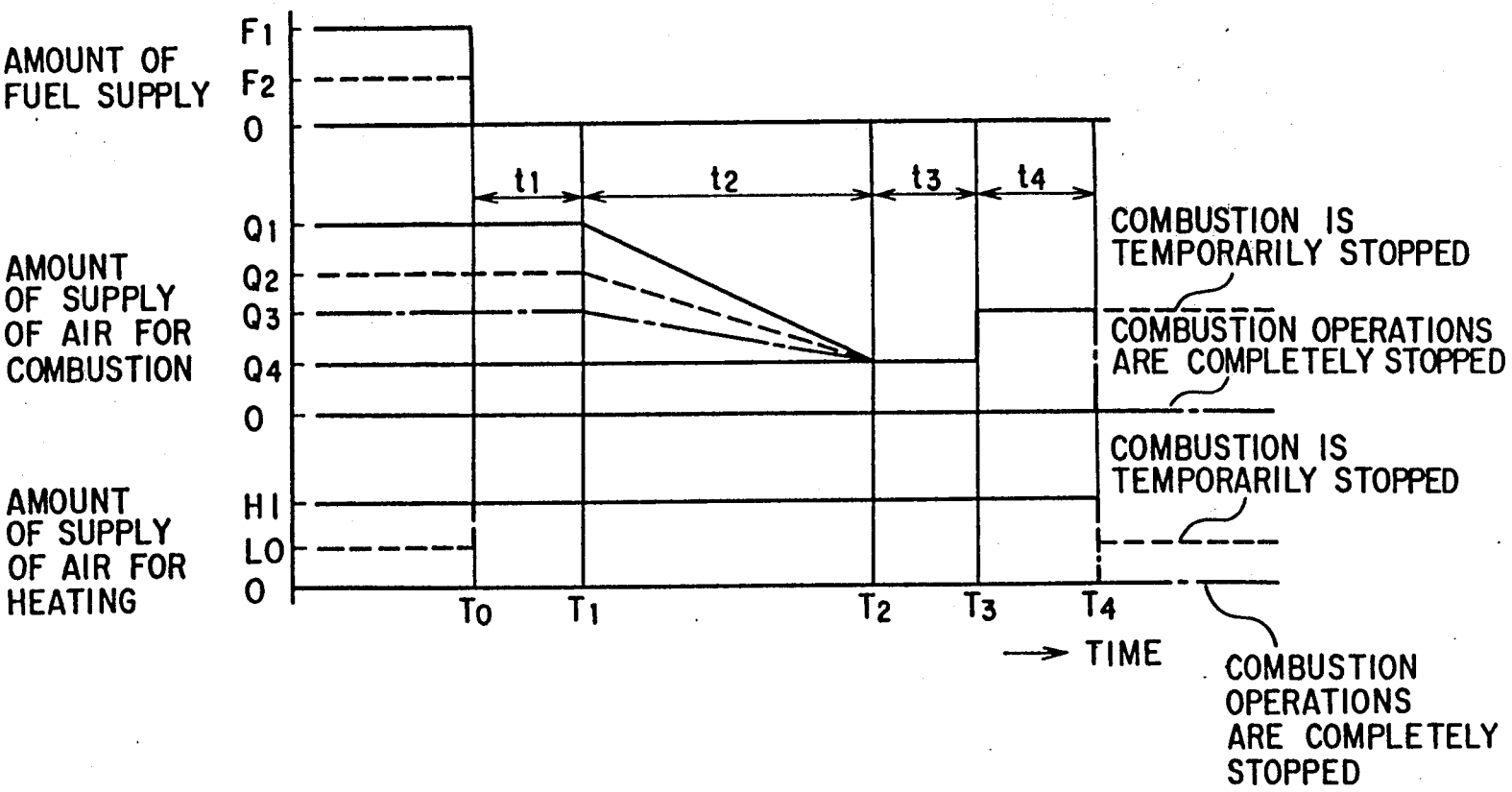
FIG. 7 is a timing chart useful in explaining the operations of component parts of the heater during extinction control.

Next, the extinction control executed at the step 606 according to the third embodiment of the invention will be described in detail with reference to FIG. 7.

First, if conditions for carrying out the extinction control of the combustion heater, which has been operated at the maximum fuel supply amount $F_1$ and at the maximum flow rate $Q_1$ of air for combustion, are satisfied at a time point $T_0$, the fuel supply amount is reduced to 0 (0 in FIG. 7) at the time point $T_0$, and the blower 10 for supplying air for combustion is caused to operate such that it continues to supply air at the flow rate $Q_1$ corresponding to the fuel supply amount $F_1$ assumed immediately before the time point $T_0$ over a first predetermined time period $t_1$, i.e. from the time point $T_0$ to a time point T1. Then, the flow rate of air for combustion is progressively reduced linearly from $Q_1$ to a predetermined amount $Q_4$ over a second predetermined time period $t_2$, i.e. from the time point $T_1$ to a time point $T_2$. More specifically, since the amount of vaporization of fuel in the combustion chamber 3 decreases as the amount of fuel remaining in the wick 4 decreases with the lapse of time, the flow rate of air for combustion is also decreased with decrease in vaporization of the remaining fuel. After the flow rate of air for combustion is reduced to $Q_4$ at the time point $T_2$, the flow rate $Q_4$ is maintained over a third predetermined time period $t_3$, i.e. from the time point $T_2$ to a time point $T_3$, to thereby burn out the fuel remaining in the wick 4.

At the time point $T_3$ and thereafter, the flow rate of air for combustion is increased to a value $Q_3$ greater than the value $Q_4$ for cooling of the combustion heater and blowing-out of the vaporized remaining fuel, and the flow rate of air for combustion is maintained at the value $Q_3$ up to a time point $T_4$, i.e. over a fourth predetermined time period $t_4$. After the time point $T_4$, the flow rate of air for combustion supplied by the blower 10 is set to either the value $Q_3$ or 0, by the steps 607 et seq of the program shown in FIG. 6.

In the meanwhile, during operation of the blower 10, the blower 15 for supplying air for heating is operated at the maximum flow rate HI from the time point $T_0$ to the time point $T_4$ for cooling the heat exchanger 23, and after the time point $T_4$, similarly to the case of the blower 10, the flow rate of air for heating supplied by the blower 15 is set to either the value LO or 0, by the steps 607 et seq of the program shown in FIG. 6.

Further, in the case where the flow rate of air for combustion supplied by the blower 10 is controlled to a value $Q_2$ corresponding to the fuel supply amount $F_2$, or in the case where the same is controlled to a value $Q_3$ to be assumed during the ignition control, the blower 10 is driven, similarly to the above, such that the flow rate of air is maintained at the value $Q_2$ or $Q_3$, respectively, up to the time point $T_1$, and thereafter the flow rate of air is progressively reduced to the predetermined value $Q_4$ over the second predetermined time period $t_2$, followed by the similar control described above.

Figure 8:
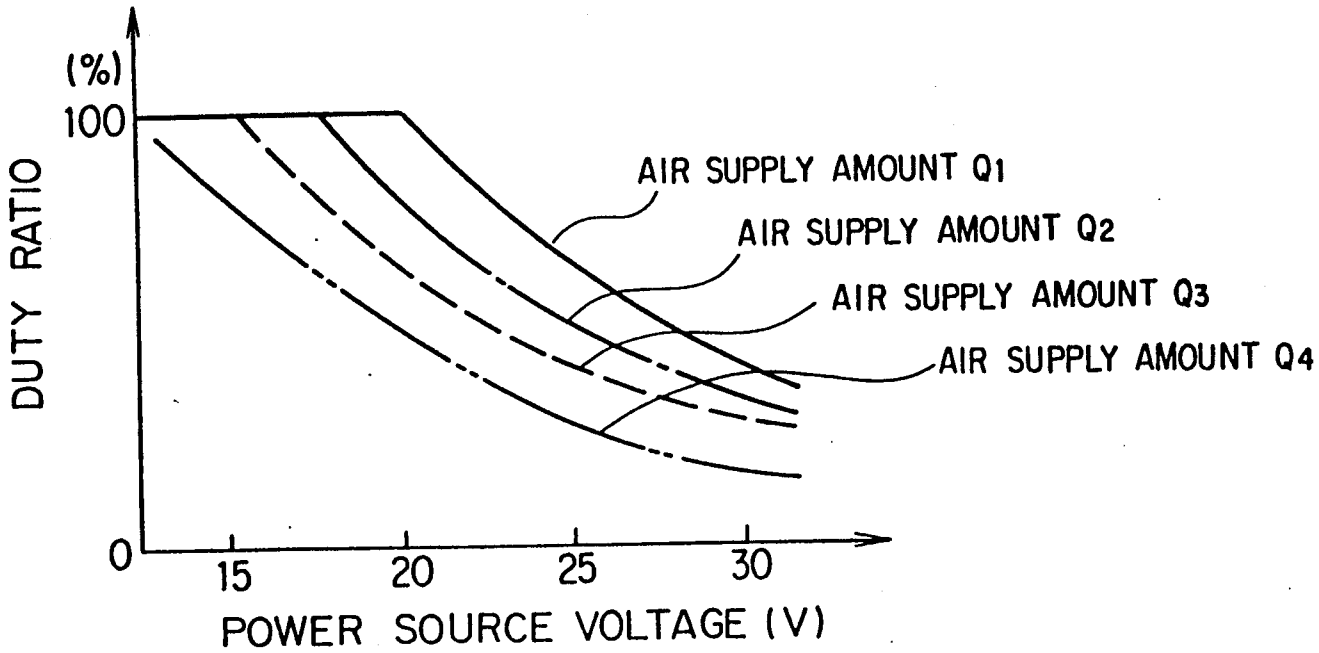
FIG. 8 is a diagram showing a duty ratio map stored in a microcomputer.

The blower 10 is operated, as shown in FIG. 8, by the microcomputer 8c through a duty ratio (ratio of duration of the on state to duration of off state in one cycle) commensurate with the power source voltage, so that a desired one of the flow rate values $Q_1$ to $Q_4$ can be obtained. Particularly, the duty ratio from the time point $T_1$ to the time point $T_2$ is calculated based on the following equation such that it is linearly decreased over the second predetermined time period $t_2$:

$$D=D_B+(D_A-D_B)x\ t/t_2 \quad (1)$$

where $D_A$ is a duty ratio of the blower 10 for supplying air at any of the flow rate values $Q_1$, $Q_2$, and $Q_3$ assumed immediately before the fuel supply amount is reduced to 0, $D_B$ a duty ratio of same for supplying air at the flow rate value $Q_4$ over the time period $T_2-T_3$, $t_2$ the time period (linear control time period) $T_1-T_2$, and t the remaining time period of the linear control time period (the remaining time period of a timer $T_{M2}$ for counting the time period $t_2$).

Figure 9A:
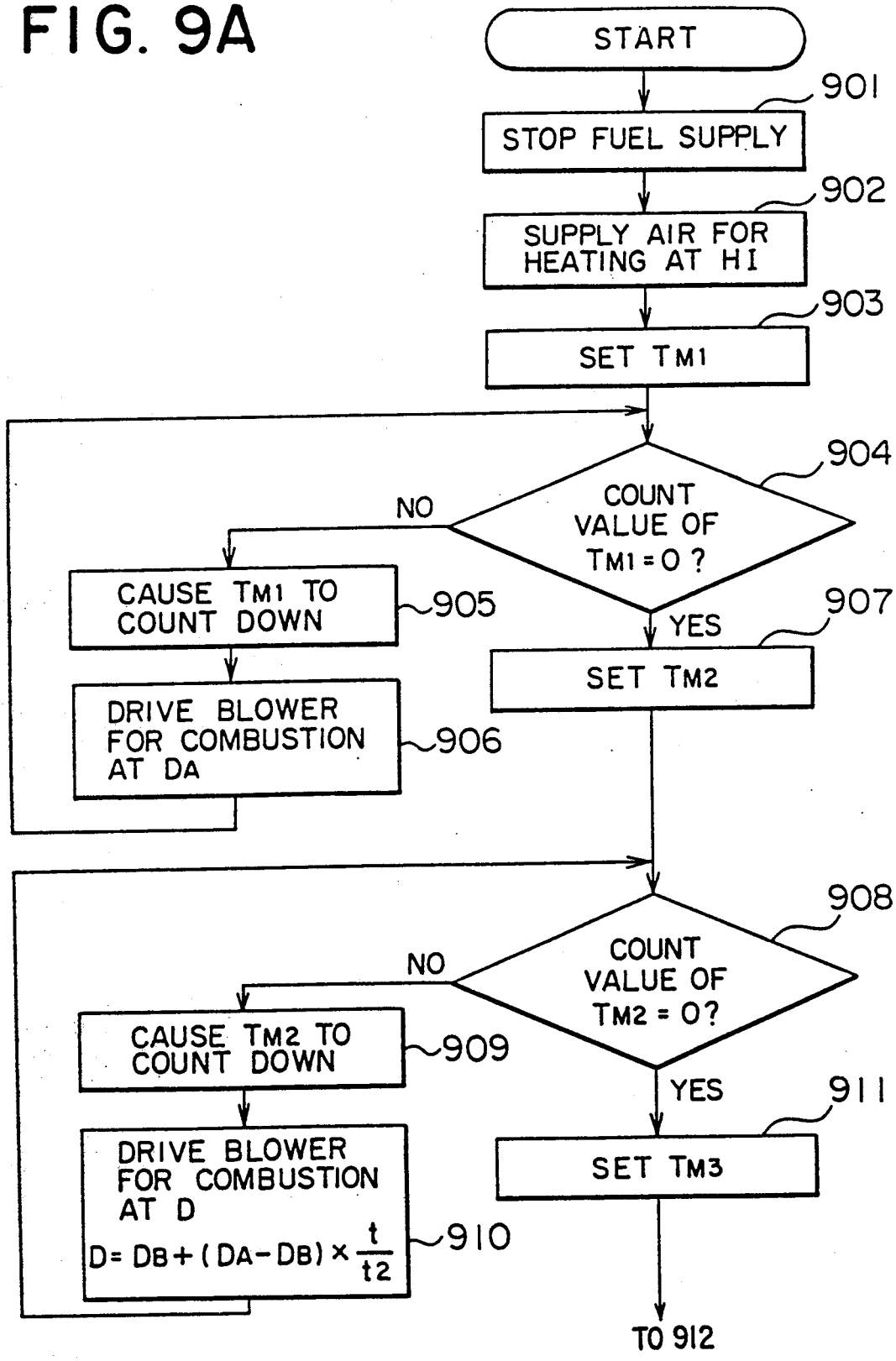
FIGS. 9A and 9B, taken together as shown in FIG. 9, are a flowchart of a subroutine for carrying out extinction control, which appears in FIG. 6, according to the third embodiment of the invention.
Figure 9B:
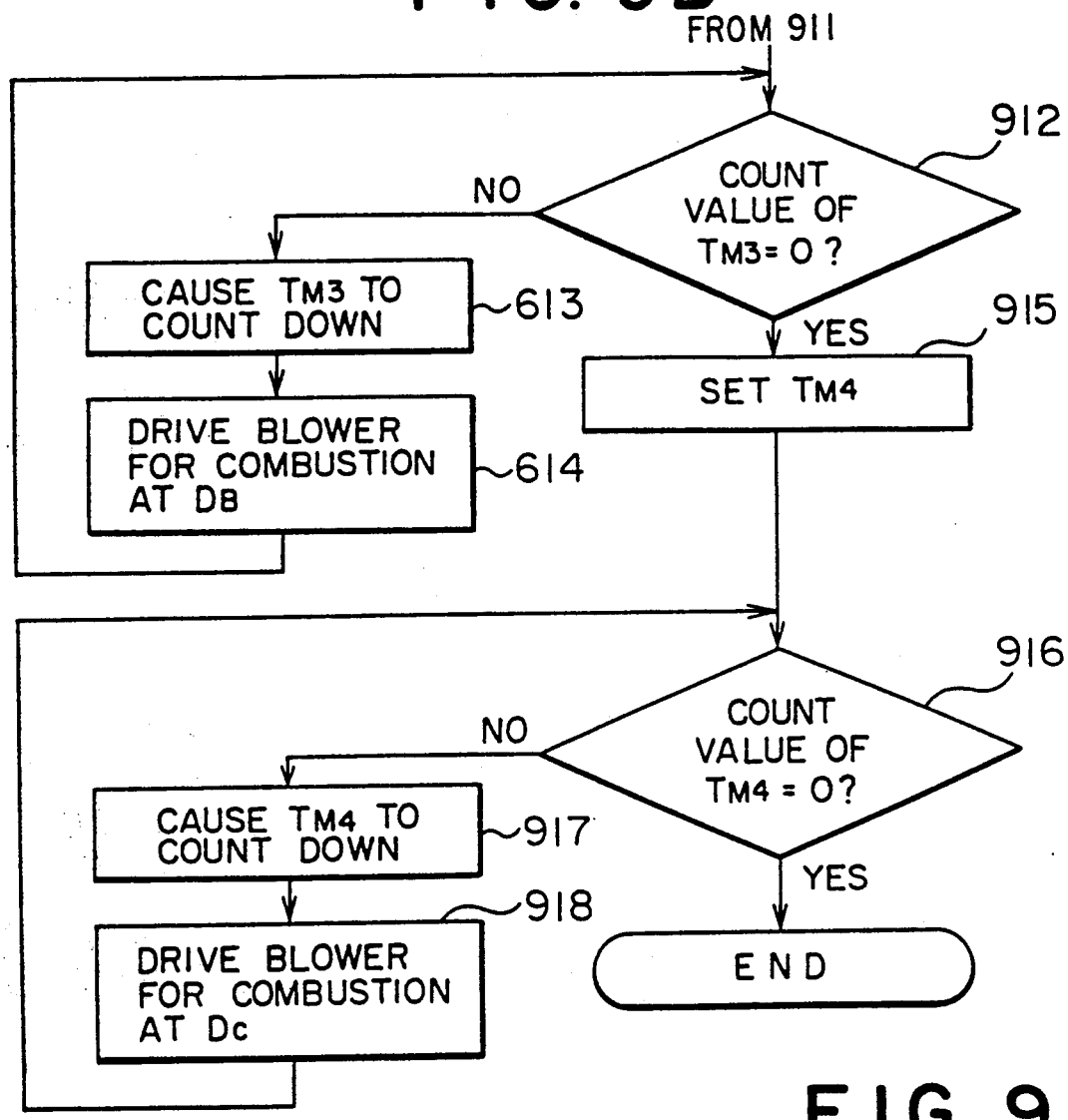
Figure 9:
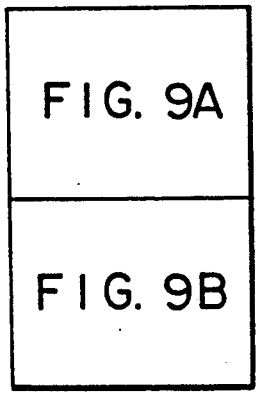

Next, a manner of carrying out the above described extinction control will be described in detail with reference to an extinction control subroutine shown in FIGS. 9A and 9B, taken together as shown in FIG. 9.

First, the fuel supply from the fuel feed pump 19 is stopped at a step 901, the flow rate of air for heating to be supplied by the blower 15 is set to HI at a step 902, and a delay timer $T_{M1}$ is set to the first predetermined time period $t_1$ at a step 903.

Then, at a step 904, it is determined whether or not the count value of the timer $T_{M1}$ set at the step 903 is equal to 0. If the answer to this question is negative (No), the program proceeds to a step 905, where the timer $T_{M1}$ is caused to count down, and then at a step 906, the blower 10 is caused to be driven at the duty ratio $D_A$, followed by the program returning to the step 904. The steps 904 to 906 are repeatedly carried out until the count value of the timer $T_{M1}$ becomes equal to 0.

If the answer to the question of the step 904 is affirmative (Yes), i.e. if it is determined that the first predetermined time period has elapsed after the fuel supply was stopped, the program proceeds to a step 907, where the delay timer $T_{M2}$ is set to the second predetermined time period $t_2$. Then at a step 908, it is determined whether or not the count value of the timer $T_{M2}$ is equal to 0. If the answer to this question is negative (No), the timer $T_{M2}$ is caused to count down at a step 909, and the blower 10 is driven at a step 910 at the duty ratio D which is calculated by the aforementioned equation (1) such that it linearly decreases, followed by the program returning to the step 908. The steps 908 to 910 are repeatedly carried out until the count value of the timer $T_{M2}$ becomes equal to 0.

If the answer to the question of the step 908 is affirmative (Yes), i.e. if it is determined that the second predetermined time period $t_2$ has elapsed, the program proceeds to a step 911, where a delay timer $T_{M3}$ is set to a third predetermined time period $t_3$, and then the program proceeds to a step 912. At the step 912, it is determined whether or not the count value of the timer $T_{M3}$ is equal to 0. If the answer to this question is negative (No), the timer $T_{M3}$ is caused to count down at a step 913, and then the blower 10 is caused to operate at the duty ratio $D_B$ (at the flow rate $Q_4$) at a step 914, followed by the program returning to the step 912. The steps 912 to 914 are repeatedly carried out until the count value of the timer $T_{M3}$ becomes equal to 0.

If the answer to the question of the step 912 is affirmative (Yes), the program proceeds to a step 915, where a delay timer $T_{M4}$ is set to the fourth predetermined time period $t_4$, and then the program proceeds to a step 916. At the step 916, it is determined whether or not the count value of the timer $T_{M4}$ is equal to 0. If the answer to this question is negative, the timer $T_{M4}$ is caused to count down at a step 917, and then the blower 10 is caused to operate at a duty ratio $D_C$ (at the flow rate $Q_3$) greater than the duty ratio $D_B$ at a step 918, followed by the program proceeding to the step 916. The steps 916 to 918 are repeatedly carried out until the count value of the timer $T_{M4}$ becomes equal to 0.

If the answer to the question of the step 916 is affirmative (Yes), the present extinction control subroutine is terminated.

Thus, by linearly decreasing the flow rate of air for combustion supplied by the blower 10 after stoppage of fuel supply, the amount of air commensurate with the amount of fuel vaporized from the wick 4 is supplied to the combustion chamber 3, which makes it possible to prevent noxious gases from being emitted and to improve the durability and ignitability of the wick 4, as well as to positively and rapidly carry out cooling of the combustion heater and blowing-out of gases containing vaporized remaining fuel.

Figure 10:
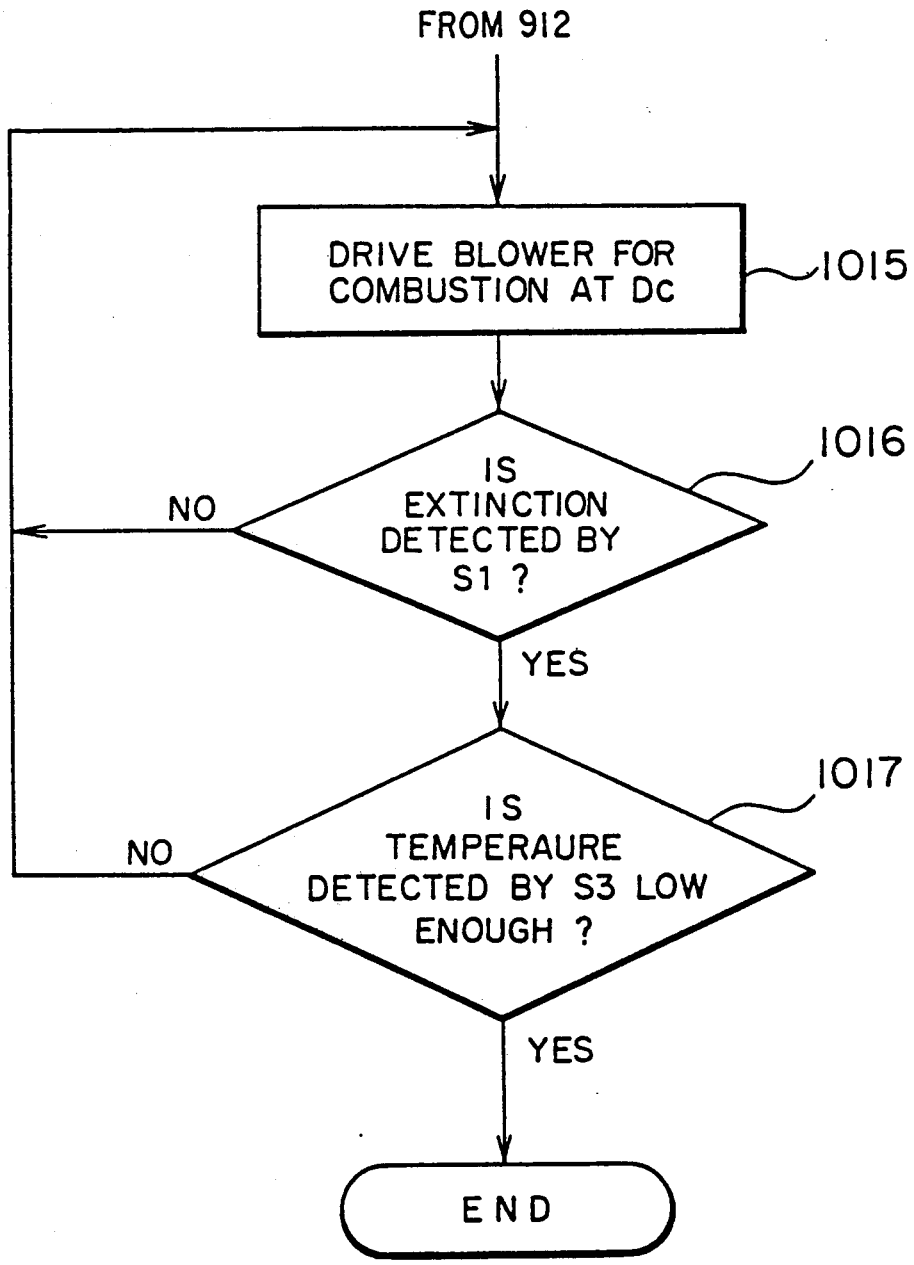
FIG. 10 is a flowchart similar to the flowchart of FIGS. 9A and 9B, showing the subroutine according to the fourth embodiment of the invention.

In this embodiment, the duration of supply of air for combustion by the blower 10 at the increased flow rate after the time point $T_3$ is set to the fourth predetermined time period $t_4$. However, this is not limitative, but the control of supply of air for combustion after the time point $T_3$ may be carried out, as shown in FIG. 10, by determining whether or not the temperature detected by the heat exchanger temperature sensor S3 is lower than a predetermined value.

Next, the extinction control responsive to the heat exchanger temperature according to the fourth embodiment of the invention will be described with reference to FIG. 10. The extinction control subroutine of FIG. 10 is different from that of FIGS. 9A and 9B only in the steps corresponding to the steps 915 to 918 of FIG. 9B. Therefore, in FIG. 10, only the different steps 1015 to 1017 corresponding to the steps 915 to 918 of FIG. 9B are shown, and the other steps identical with the steps 901 to 914 are omitted.

In this embodiment, if the step 912 of FIG. 9B is affirmative (Yes), i.e. if the count value of the delay timer $T_{M3}$ is equal to 0, the program proceeds to a step 1015, where the blower 10 is driven at the duty ratio $D_C$ (at the flow rate $Q_3$), and then it is determined at a step 1016 whether or not the ignition sensor S1 has detected extinction of fire in the combustion chamber 3. If the answer is negative (No), the program returns to the step 1015 to execute same, whereas if the answer is affirmative (Yes), the program proceeds to a step 1017, where it is determined whether or not the temperature detected by the heat exchanger temperature sensor S3 is lower than a predetermined value (e.g. 80° C.). If the answer to this question is negative (No), the program returns to the step 1015 to carry out the steps 1015 and 1016, whereas if the answer is affirmative (Yes), the present subroutine is terminated, judging that the combustion heater is sufficiently cooled and gases containing vaporized fuel are completely blown out of the heater.

What is claimed is:

1. In a combustion heater for heating a vehicle compartment or for keeping foods warm, said combustion heater including a combustor having a glow plug, voltage-applying means for applying a voltage to said glow plug, fuel supply means for supplying fuel to said combustor, air supply means for supplying air for combustion to said combustor, ignition-detecting means for detecting ignition of said combustor, and control means for controlling operations of said glow plug, said voltage-applying means, said fuel supply means, and said air supply means, the improvement wherein said control means is responsive to an instruction signal instructing starting ignition of said combustor supplied thereto for starting to cause said voltage-applying means to apply a first predetermined voltage to said glow plug, and at the same time starting to cause both of said fuel supply means and said air supply means to operate for a first predetermined time period which is substantially shorter than a possible time period from the supply of said instruction signal to occurrence of ignition of said combustor, and when ignition of said combustor is detected by said ignition-detecting means, said control means starts to cause both of said fuel supply means and said air supply means to operate, and at the same time starts to cause said voltage-applying means to apply a second predetermined voltage lower than said first predetermined voltage to said glow plug.

2. A combustion heater according to claim 1, wherein said control means causes said voltage-applying means to apply a third predetermined voltage lower than said first predetermined voltage to said glow plug after a second predetermined time period has elasped after said first predetermined time period elaspsed, until ignition of said combustor is detected by said ignition-detecting means.

3. A combustion heater according to claim 2, wherein said third predetermined voltage is higher than said second predetermined voltage.

4. A combustion heater according to claim 1, wherein said second predetermined voltage is applied for a predetermined time period after ignition of said combustor has been detected.

5. A combustion heater according to claim 2, wherein after said first predetermined time period has elapsed, whenever a third predetermined time period elapses, said control means causes said air supply means to operate for a fourth predetermined time period.

6. A combustion heater according to claim 1, wherein said detection of ignition by said ignition-detecting means is carried out by determining whether or not said ignition-detecting means has a resistance value larger than a predetermined value.

7. In a combustion heater for heating a vehicle compartment or for keeping foods warm, said combustion heater including a combustor, fuel supply means for supplying fuel to said combustor, air supply means for supplying air to said combustor, and extinction control means responsive to an instruction signal instructing stopping combustion of said combustor supplied thereto for stopping fuel supply by said fuel supply means and causing said air supply means to supply air to said combustor, the improvement wherein said extinction control means is responsive to said instruction signal supplied thereto for causing said air supply means to supply air to said combustor at a flow rate at which air has been supplied to said combustor immediately before said instruction signal is supplied to said extinction control means, for a first predetermined time period, and after said first predetermined time period has elapsed, said extinction control means causes said flow rate to be progressively decreased to a first predetermined flow rate over a second predetermined time period, and then causes said air supply means to supply air to said combustor at a second predetermined flow rate larger than said first predetermined flow rate.

8. A combustion heater according to claim 7, wherein said first predetermined flow rate of air is maintained over a third predetermined time period.

9. A combustion heater according to claim 7, wherein said second predetermined flow rate of air is maintained over a fourth predetermined time period.

10. A combustion heater according to claim 7, including a heat exchanger, and a sensor for detecting the temperature of said heat exchanger, and wherein said second predetermined flow rate of air is maintained until the temperature of said heat exchanger detected by said sensor becomes lower than a predetermined value.

11. A combustion heater according to claim 2, wherein said detection of ignition by said ignition-detecting means is carried out by determining whether or not said ignition-detecting means has a resistance value larger than a predetermined value.

12. A combustion heater according to claim 3, wherein said detection of ignition by said ignition-detecting means is carried out by determining whether or not said ignition-detecting means has a resistance value larger than a predetermined value.

13. A combustion heater according to claim 4, wherein said detection of ignition by said ignition-detecting means is carried out by determining whether or not said ignition-detecting means has a resistance value larger than a predetermined value.

14. A combustion heater according to claim 5, wherein said detection of ignition by said ignition-detecting means is carried out by determining whether or not said ignition-detecting means has a resistance value larger than a predetermined value.

15. A combustion heater according to claim 8, wherein said second predetermined flow rate of air is maintained over a fourth predetermined time period.

16. A combustion heater according to claim 8, including a heat exchanger, and a sensor for detecting the temperature of said heat exchanger, and wherein said second predetermined flow rate of air is maintained until the temperature of said heat exchanger detected by said sensor becomes lower than a predetermined value.

17. In a combustion heater for heating a vehicle compartment or for keeping foods warm, said combustion heater including a combustor having a glow plug, voltage-applying means for applying a voltage to said glow plug, fuel supply means for supplying fuel to said combustor, air supply means for supplying air for combustion to said combustor, ignition-detecting means for detecting ignition of said combustor, and control means for controlling operations of said glow plug, said voltage-applying means, said fuel supply means, and said air supply means, the improvement wherein said control means is responsive to an instruction signal instructing starting ignition of said combustor supplied thereto for starting to cause said voltage-applying means to apply a first predetermined voltage to said glow plug, and at the same time starting to cause both of said fuel supply means and said air supply means to operate for a first predetermined time period, and when ignition of said combustor is detected by said ignition-detecting means, said control means starts to cause both of said fuel supply means and said air supply means to operate, and at the same time starts to cause said voltage-applying means to apply a second predetermined voltage lower than said first perdetermined voltage to said glow plug;

said control means causing said voltage-applying means to apply a third predetermined voltage lower than said first predetermined voltage to said glow plug after a second predetermined time period has elapsed after said first predetermined time period elapsed, until ignition of said combustor is detected by said ignition-detecting means.

18. A combustion heater according to claim 17, wherein said third predetermined voltage is higher than said second predetermined voltage.

19. A combustion heater according to claim 17, wherein said second predetermined voltage is applied for a predetermined time period after ignition of said combustor has been detected.

20. A combustion heater according to claim 17, wherein after said first predetermined time period has elapsed, whenever a third predetermined time period elapses, said control means causes said air supply means to operate for a fourth predetermined time period.

* * * * *